United States Patent [19]

Tomiser, Jr.

[11] Patent Number: 4,811,623

[45] Date of Patent: Mar. 14, 1989

[54] POWER TOOL HANDWHEEL/CRANK

[75] Inventor: Frank J. Tomiser, Jr., St. Louis, Mo.

[73] Assignee: Emerson Electric Co., St. Louis, Mo.

[21] Appl. No.: 86,308

[22] Filed: Aug. 17, 1987

[51] Int. Cl.[4] ..... G05G 1/00

[52] U.S. Cl. ..... 74/547

[58] Field of Search ..... 74/527, 10.41, 495, 74/547, 548

[56] References Cited

U.S. PATENT DOCUMENTS

| | | | |
|---|---|---|---|
| 1,307,960 | 6/1919 | Curtis | 74/547 |
| 2,165,060 | 7/1939 | Krug | 74/547 |
| 2,727,406 | 12/1955 | Opocensky | 74/547 X |
| 3,061,222 | 10/1962 | Beach | 74/547 X |
| 3,477,309 | 11/1969 | Sprecher | 74/547 |
| 3,517,571 | 6/1970 | Treber et al. | 74/547 |
| 4,588,141 | 5/1986 | Uetsuki et al. | 74/547 X |

FOREIGN PATENT DOCUMENTS

| | | | |
|---|---|---|---|
| 15575 | 10/1881 | Fed. Rep. of Germany | 74/547 |
| 2773 | of 1877 | United Kingdom | 74/547 |

*Primary Examiner*—Peter A. Aschenbrenner

*Attorney, Agent, or Firm*—Polster, Polster and Lucchesi

[57] ABSTRACT

A combination handwheel/crank for a power tool, such as a radial arm saw or the like, is disclosed with the power tool having a base or frame, a component adjustably movable relative to the base and rotatably driven adjustment mechanism for moving the component relative to the base with this adjustment mechanism having a drive shaft. This crank assembly is provided for rotatably driving the drive shaft, this crank assembly having a hub adapted to securely receive the drive shaft with the hub having an enlarged hub body facilitating the precision manual rotary adjustment of the component. The crank assembly has a crank handle carried by the hub body and radially offset from the hub. The crank is pivotally movable with respect to the hub body between a folded position in which the crank is substantially coplanar with the outer surface of the hub body such that a user may readily manually grip the periphery of the hub body without interference from the crank handle for the precision manual adjustment of the component and an extended position in which the crank is radially offset from the hub body thereby to permit the coarse rotary adjustment of the component.

5 Claims, 3 Drawing Sheets

POWER TOOL HANDWHEEL/CRANK

BACKGROUND OF THE INVENTION

This invention relates to a handwheel/crank assembly for a power tool, in more particularly to such a handwheel/crank assembly used in adjusting a component of a power such as in moving the head of a radial arm saw or the like in vertical direction.

As shown in FIG. 5, power tools typically had a conventional crank handle which was used to manually rotate an adjustment shaft. However, it has been found that such crank handles did not permit the fine adjustment of the component adjustably driven thereby but, instead, was better suited for rapid and coarse adjustment. Additionally, the crank handle protruded outwardly from the machine tool and oftentimes would be bumped by an operater thus possibly causing injury to the operator and also altering the adjustment of the power tool.

SUMMARY OF THE INVENTION

Among the several objects and features of the present invention may be noted the provision of a handwheel/crank assembly for a power tool or the like in which the handwheel/crank utilizes a foldable crank handle which, when in its folded position, is coplanar with the hub so as to minimize the possibility of its being bumped by an operator;

In provision of such a handwheel/crank which, when the crank handle is folded substantially flat, permits a user to manually grip the outer periphery of an enlarged hub body thus enabling the precise adjustment of the power tool;

The provision of such handwheel/crank assembly which, when the handle is extended, permits rapid adjustment;

The provision of such a handwheel/crank assembly in which the handwheel/crank hub is positively secured to the drive shaft;

The provision of such a handwheel/crank assembly in which the manner the crank handle is pivotally attached to the hub securely attaches the handle to the hub and resiliently holds the handle relative to the hub as the handle is pivotably moved between its folded and extended position;

The provision of such a handwheel/crank which may be molded of a suitable synthetic resin and yet has a hard metal insert for engaging and rotating a shaft driven thereby;

The provision of such a handwheel/crank which positively locks the handle relative to the hub in its extended position;

The provision of such a handwheel/crank which is of rugged construction, which is of an attractive appearance, which may have serveral applications on a single machine tool, which is easy and relatively inexpensive to fabricate, and which will have a long service life.

Other objects and features of this invention will be in part apparent and in part pointed out hereinafter.

Briefly stated, this invention relates to an adjustment handwheel/crank assembly for a power tool with the later having a base or frame, a component carried by the base or frame which is adjustably moveable relative to the base, Rotatably driven means is provided for adjustably moving the component with the driven means having a rotary drive shaft. Specifically, this handwheel/crank assembly rotatably drives the drive shaft of the driven means. The handwheel/crank assembly has a hub including an enlarged circular hub body, this hub body having a hub at the center thereof for securely receiving and for positively rotatably driving the drive shaft. The hub body has a generally circular periphery so constructed as to facilitate the precision manual rotary adjustment of the handwheel/crank assembly. The hub assembly further has a crank handle carried by the hub body with the crank handle being pivotally mounted with respect the hub body at a position radially offset from said hub. The crank is pivotally movable with respect to the hub body between a folded position in which crank handle is substantially coplanar with the outer face of the hub body such that a user may readily manually grip the periphery of the hub body substantially without interferance from the crank handle for the precision manual adjustment of the component and an extended position in which the crank handle is radially offset from the hub thereby to permit coarse rotary adjustment of the component.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
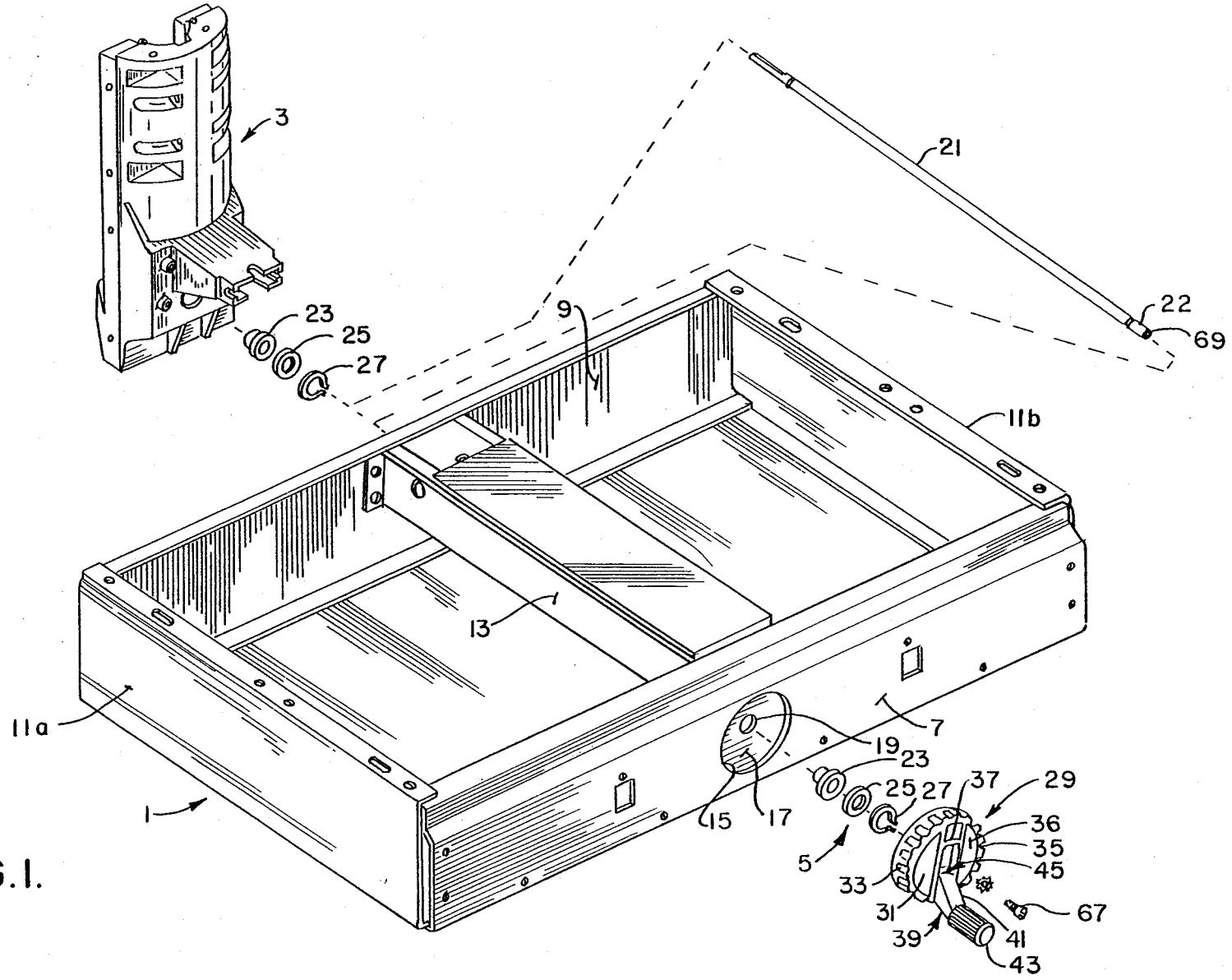
FIG. 1 is a perspective, exploded view of a base frame for a power tool (e.g. a radial arm saw) having a component (e.g. a vertical adjustment drive housing) of the power tool which houses an adjustment mechanism (not shown, e.g. a gear train) which in turn is adjusted by means of a rotary drive shaft rotatably driven by a handwheel/crank assembly of the present invention.
Figure 5:
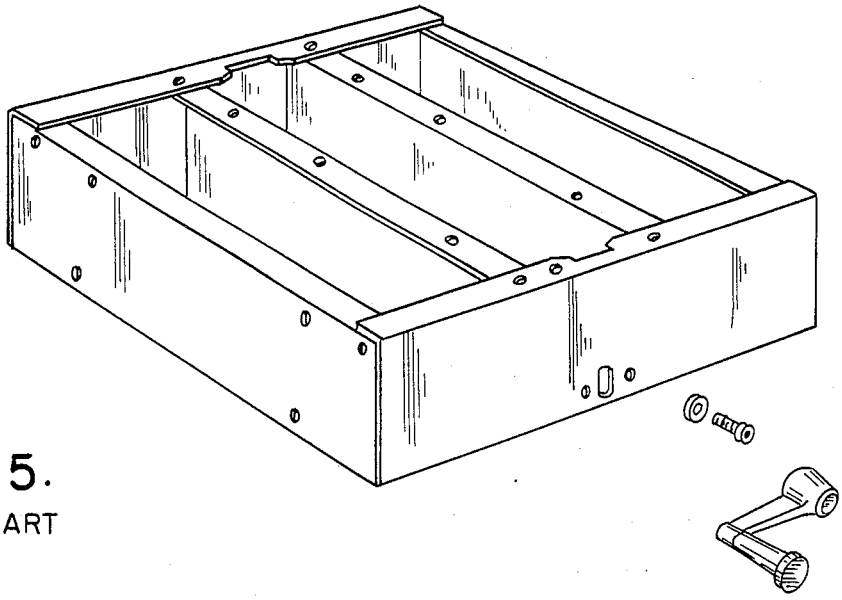
FIG. 5. PRIOR ART
FIG. 5 is a perspective view of a power tool frame illustrating a prior art crank handle for driving a rotary adjustment system.
Figure 3:
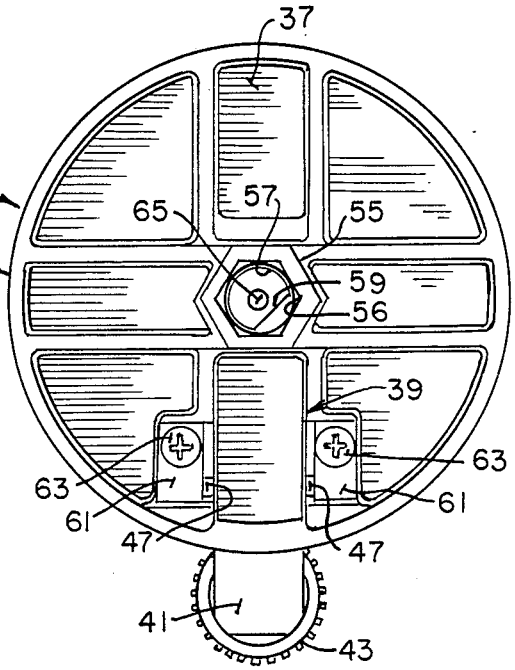
FIG. 3 is a rear elevational view of the handwheel/crank assembly shown in FIG. 2.

Referring now to the drawings, and more particularly to FIG. 1, a power tool frame is illustrated in its entirety by reference character 1. For example, frame 1 may be the frame of a radial arm saw or other power tool. The power tool includes a tool component, as generally indicated at 3, which is a housing which surrounds an adjustment drive system (not shown) for the power tool, such as a gear train, which may be rotatably driven for effecting raising and lowering the arm of a radial arm saw relative to the work table. As generally indicated at 5, means is provided for the manual, rotatable adjustment of the adjustment mechanism (not shown) housed within component housing 3 of the power tool.

More specifically, frame 1 comprises a front sheet metal wall 7, a back wall 9, and side walls 11*a*, 11*b* securely joining the front and back walls. At the center of the front and back walls, a channel 13 extends therebetween. Front wall 7 has a generally circular opening 15 intermediate its ends. A bracket 17 is securely fastened to the backside of front wall 7 within channel 13 and bracket 17 has an opening 19 therein.

Rotary adjustment means 5 comprises an elongate rotatably driven drive shaft 21 adapted to be inserted through channel 13 with one end being so keyed as to positively engage the drive mechanism (not shown) housed within the power tool component housing 3 and with the other end extending out beyond opening 19 and bracket 17. The end of the drive shaft which extends out beyond bracket 17 has a flat 22 thereon to enable it to be positively driven in a manner as will appear. At each end of shaft 21, a thrust washer 23, a bearing washer 25, and a retainer ring 27 is provided so as to journal and so as to securely locate shaft 21 within frame 1.

As generally indicated at 29, a handwheel/crank assembly of the present invention is securely affixed (in a manner as will appear) to the outer end of rotary drive shaft 21 for both the coarse and fine adjustment of the rotary drive shaft and the power tool adjustment mechanism in housing 3 driven thereby. More specifically, handwheel/crank assembly 29 includes a generally circular shaped , one pieced hub body 31 preferrably molded of a suitable synthetic resin material. The hub body 31 has an outer circular peripherial surface 33 having a plurality of longitudinal flutes 35 integrally formed therein so as to facilitate the manual gripping of the periphery of the hub body for precise manual adjustment purposes. The outer planar face 36 of the hub body has a diametric recess 37 formed therewithin.

A crank handle assembly, as generally indicated at 39, is pivotally mounted with respect to hub body 31 at a position radially offset from the center of the hub body such that when the handle assembly 39 is in its extended position (as shown in FIGS. 1–4), so as to facilitate coarse rotary adjustment of the power tool. More specifically, the crank handle assembly 39 includes a crank arm 41 having a crank knob 43 rotatably mounted on the outer end thereof. The crank arm 41 is pivotably mounted with respect to the hub body for pivotal movement between an extended position (as shown in solid lines in FIG. 2) in which the crank arm 41 with the handle 43 is radially offset from the center of the hub body and in which the crank knob is generally parallel to the axis of rotation of the hub body and a folded position (as shown in phantom lines in FIG. 2) in which at least a portion of crank arm 41 and at least a portion of the knob 43 are received within recess 37 such that the crank handle assembly 39 does not substantially interfere with the manual rotary adjustment of the hub body by a user manually gripping the outer periphery 33 of the hub body.

Figure 2:
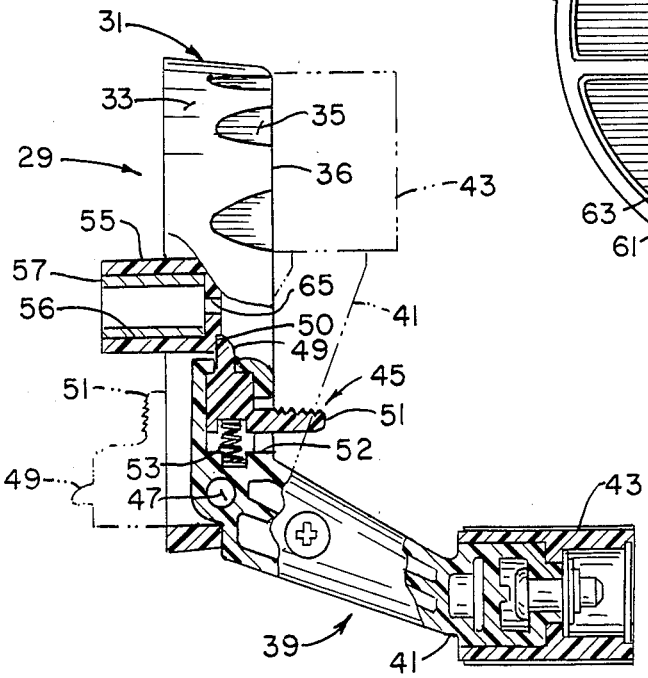
FIG. 2 is a side elevational view of the handwheel/crank assembly of the present invention with portions thereof broken away illustrating details of construction and with the handle assembly shown in solid lines in its extended position in which the handle is radially offset from the center of the hub body and further illustrating, in phantom lines, the handle folded in its folded position in which the crank handle is substantially coplanar with the hub assembly such that one may readily grip the outer periphery of the hub assembly for fine or precision rotary of the handle.
Figure 4:
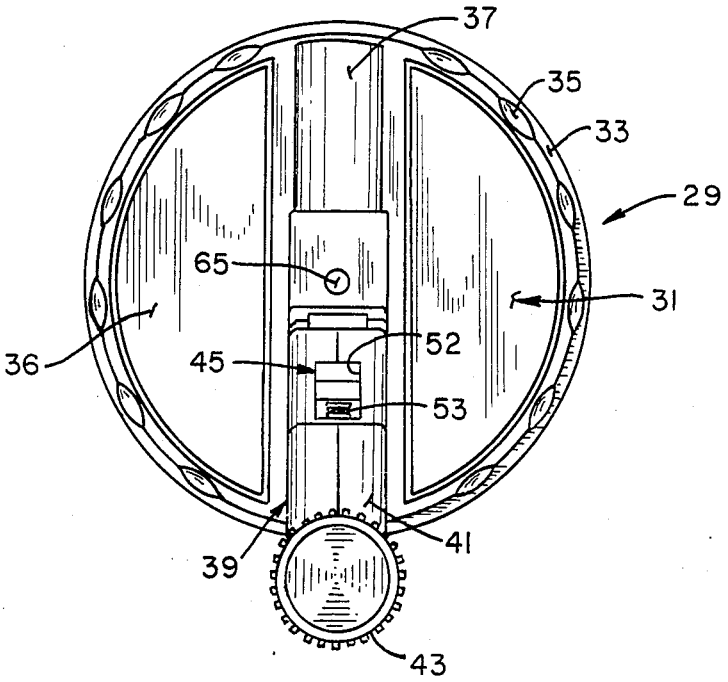
FIG. 4 is a front elevational view of FIG. 2.

More specifically, crank handle 39 includes a pivot hinge or trunnion 47 extending outwardly from each side of crank arm 41. These pivot trunnions are engageable with suitable bearing surfaces (not shown) provided on the back side of hub body 31. The latch assembly 45 for positively locking crank arm 41 in its extended position comprises a spring loaded keeper 49 which is resiliently movable between a locking position (as shown in FIG. 2) in which the keeper is in engagement with a locking surface 50 provided on hub body 31 so as to prevent pivotal movement of the crank handle about trunnions 47 from its extended toward its folded position. The keeper has a release lever 51 integral therewith which extends out through an opening 52 in crank arm 41 so that it may be readily manually moved from its locking position (as shown in FIG. 2) to a release position (not shown) in which the keeper 49 is clear of locking surface 50 thereby to permit pivotal movement of the crank arm 41 about pivot trunnions 47 toward its folded position. A compression coil 53 spring interposed between a portion of the crank arm and the keeper 49 resiliently biases the keeper toward its locking position.

Still more specifically, hub body 31 includes a central hub 55 generally coaxial with the center of the hub body. As shown best in FIG. 3, hub 55 has a hexagonally shaped opening 56 therein which is so dimensioned so as to receive a powdered metal insert 57 which has a hexagonal outer surface and which is securely press fit into the hexagonal opening of hub 55 and which is thus positively held against rotating with respect to the central hub 55. Insert 57 includes a flattened inner surface 59 therein for positive engagement with the corresponding flat 22 on the outer end of drive shaft 21 thereby to permit the positive rotary engagement of the hub with the drive shaft 21.

As indicated at 61, resilient metal tabs 65 are mounted on the backside of hub body 31 adjacent each side of crank arm 41 so as to overlie and resiliently engage trunnions 47 extending outwardly from the crank arm. These tabs are positively secured to the hub body by means of screws 63. By positively tightening the screws, resilient tab 61 resiliently engage trunnions 47 and firmly press them into a tight fitting relation with corresponding surfaces of the hub body on the opposite sides of the trunnions. In this manner, the tabs 61 act as a resilient clutch for gripping the trunnions and for applying a resilient force thereto which permits pivotal movement of the crank arm between its folded and extended position, but yet resists pivotal movement thereof such that the crank arm will stay in its folded position or in any intermediate position. Of course, when the crank arm is in its fully extended position, keeper 49 is spring biased so as to latchingly engage the shoulder 50 provided on the back face of hub 55.

A central opening 65 is provided in the outer face of hub body 31 and extends into hub 55. This central opening 65 is intended to receive a suitable screw 67 (as shown in FIG. 1) which in turn threadably engages a threaded opening 69 in the end of drive shaft 21. In this manner, with the flat 22 on the outer end of drive shaft 21 inserted into the opening of insert 57, with the flat 59 of the insert engaging flat 22 on shaft 21, and with screw 67 inserted into opening 65 and threadably engaging the end of the drive shaft, the drive shaft is positively rotatably secured relative to the crank/handle assembly 29 of the present invention.

In view of the above, it will be seen that the several objects and features of this invention are achieved and other advantageous results attained.

As various changes in the above construction without departing from the scope of the invention, it is intended that all matter contained in the above description or shown in the accompanying drawing be interpreted as illustrative and not in a limiting sense.

I claim:

1. An adjustment handwheel/crank assembly for a power tool with the later having a base or frame, a component carried by the base or frame which is adjustably moveable relating to the base rotatably driven means for adjustably moving the component with the driven means having a rotary drive shaft, said handwheel/crank assembly rotatably driving said driven means, said handwheel/crank assembly having a hub including an enlarged circular hub body, said hub body having a hub at the center thereof for securely receiving and for positively rotatably driving said drive shaft, said hub body having a generally circular periphery so constructed as to facilitate the precision manual rotary adjustment of said handwheel/crank assembly, said hub assembly further having a crank handle carried by said hub body with said crank handle being pivotally mounted with respect to said hub body at a position radially offset from said hub, said crank being pivotally movable with respect to said hub body between a folded position in which crank handle is substantially coplanar with the outer face of said hub body such that a user may readily manually grip said periphery of said hub body substantially without interference from said crank handle for said precision manual adjustment of said component and an extended position in which said crank handle is radially offset from said hub thereby to permit coarse rotary adjustment of said component; said crank having a trunnion extending outwardly therefrom engageable with a selected area of said hub body, and a tab secured to said hub body and resiliently gripping said trunnion so as to resiliently mount said crank on said hub body.

2. A handwheel/crank as set forth in claim 1 wherein said hub body has a hub on the backside thereof, said hub having a polygonal-shaped opening, an insert having a polygonal-shaped outer cross section inserted into said hub opening, said insert having an insert opening for positively receiving one end of said drive shaft.

3. A handwheel/crank as set forth in claim 1 further comprising means for positively latching said crank in its fully extended position.

4. A handwheel/crank as set forth in claim 3 wherein said latch means comprises a keeper carried by said crank, said keeper being movable relative to said crank between a latching position in which it is engageable with a surface on said hub body so as to positively prevent pivotal movement of crank from its extended position toward its folded position and a retracted position in which keeper is clear of said hub body surface so as to enable said crank to be pivotally movable toward its folded position, and a spring for biasing said keeper toward its latching position.

5. A handwheel/crank assembly as set forth in claim 4 wherein said hub body has a recess in the outer face thereof for at least in part receiving said crank knob and said crank arm when the latter is in its folded position.

* * * * *